United States Patent [19]

Weitzman et al.

[11] 3,944,314

[45] Mar. 16, 1976

[54] TERMINAL FOR ESTABLISHING A STABLE ELECTRICAL CONNECTION TO ALUMINUM WIRE

[75] Inventors: Milton J. Weitzman, Bayside; Saul Rosenbaum, East Meadow, both of N.Y.

[73] Assignee: Leviton Manufacturing Co., Inc., Brooklyn, N.Y.

[22] Filed: Mar. 15, 1974

[21] Appl. No.: 451,610

Related U.S. Application Data

[63] Continuation of Ser. No. 262,648, June 14, 1972, abandoned.

[52] U.S. Cl. ..... 339/95; 339/269

[51] Int. Cl.[2] ..... H01R 9/08

[58] Field of Search ..... 339/95 R, 95 A, 98, 269, 339/278 C

[56] References Cited

UNITED STATES PATENTS

| | | | |
|---|---|---|---|
| 3,511,921 | 5/1970 | Pasternak | 339/98 X |
| 3,719,919 | 3/1973 | Tibolla | 339/95 A |
| 3,786,398 | 1/1974 | Snider | 339/95 R |

*Primary Examiner*—Roy Lake
*Assistant Examiner*—E. F. Desmond
*Attorney, Agent, or Firm*—Cushman, Darby & Cushman

[57] ABSTRACT

This invention relates to a new and improved terminal for electrically connecting an aluminum wire to a wiring device which is stable and will prevent overheating during use.

The subject terminal comprises a terminal plate of conductive material having a serrated surface coated with indium which is held in engagement with a bare end of an aluminum wire under pressure. The serrated surface contains a multitude or closely spaced serrations having sharp edges and is plated with a thin layer of indium. The bare end of an aluminum wire is urged into engagement with the serrated surface of the terminal plate under pressure from a terminal screw or the like. The serrations mechanically anchor the wire against movement relative to the terminal plate and create breaks or asperities in an oxide film on the surface of the aluminum wire to establish contact sites between the wire and the terminal plate through which electric current can flow with low resistance. The indium coating on the terminal plate spreads over and protects the asperities in the wire against further oxidation to maintain the electrical characteristics of the connection and permit the flow electric current between the wire and the terminal plate without overheating during use.

5 Claims, 7 Drawing Figures

TERMINAL FOR ESTABLISHING A STABLE ELECTRICAL CONNECTION TO ALUMINUM WIRE

This application is a continuation of our copending application Ser. No. 262,648, filed June 14, 1972, now abandoned, the contents of the official file of which are hereby incorporated hereinto by reference.

The present invention relates to a new and improved terminal for electrically connecting an aluminum wire to a wiring device or the like. It relates, more particularly, to a terminal which will prevent the wire or the device from overheating during use over an extended period of time.

In general, the subject invention may be incorporated in various forms of terminals for use on different types of wiring devices. The particular form of terminal illustrated herein is a screw terminal formed as part of a contact of conductive material which is supported in a housing of a dual receptacle or outlet. The terminal comprises a terminal plate exposed at one side of the housing with a terminal screw threaded therein to receive and hold a bare end of the wire in engagement with an opposing surface of the terminal plate under pressure.

In accordance with the present invention, the surface of the terminal plate which engages with the wire contains a large number of closely spaced serrations having sharp upper edges. Generally, the serrations extend across or transversely of segments of the end of the wire which is looped around the terminal screw. As the terminal screw is tightened, the wire is brought into engagement with the serrations under pressure from the screw and the edges of the serrations create numerous breaks or asperities in a film of aluminum oxide ($Al_2O_3$) on the surface of the wire. The film of aluminum oxide forms instantaneously on the aluminum wire when it is exposed to air and acts as an insulator. However, the breaks or asperities in the oxide film form contact sites on the surface of the wire through which electric current can flow at low resistance from the wire to the terminal plate.

To protect the contact sides, a thin layer of indium is applied to the serrated surface of the terminal plate and maintains the required electrical conditions. The indium coating on the terminal plate has the ability to wet and spread over the surface of the aluminum wire and thus, protects the breaks or asperities in the oxide film on the surface of the wire against further oxidation which maintains the desired electrical conditions.

The serrations in the surface of the terminal plate also serve to anchor the wire against movement of the wire relative to the terminal plate during installation. Such loosening might affect the electrical connection after the terminal screw has been tightened.

OBJECTS OF THE INVENTION

With the foregoing in mind, an object of the invention is to provide a terminal for electrically connecting an aluminum wire to a wiring device which will have stable electric characteristics and prevent overheating of the wire or the device during use.

Another object of the invention is to provide a terminal for electrically connecting an aluminum wire to a wiring device which has low resistance and which is not subject to change due to the flow of electric current through the connection.

BACKGROUND

Aluminum wire is an excellent and relatively inexpensive conductor of electricity and the use of aluminum wire is becoming of increasing significance for economic reasons. However, special precautions must be taken in making terminal connections to aluminum wire or overheating is apt to result due to the flow of electric current and a poor connection. Such overheating is frequently sufficient to cause fire and for this reason, the use of aluminum wire for household or industrial wiring has been banned in many communities despite the economy. Although extensive efforts have been made to overcome the problem of overheating, such efforts have so far not met with success.

A number of factors enter into the problem and must be taken into account in making an electrical connection to aluminum wire. One factor is that a film of aluminum oxide ($Al_2O_3$) forms practically instantaneously on the surface of aluminum wire when it is exposed to air. This film of aluminum oxide is not only extremely hard, but it also has good insulating properties and makes it difficult to establish a good electrical connection of low resistance to aluminum wire.

Another factor is that the composition of aluminum used in the manufacture of wire varies and such differences will have a bearing on the nature of an electrical connection of a particular wire and the ability to make an electrical connection thereto. In this respect it should be noted that aluminum wire is classified by the advisory authorities as "good" or "bad", with ranges of each type, for the purpose of making electrical connections thereto.

Other factors are that cold flow takes place with aluminum wire and differences in thermal expansion between the wire and terminal may exist which will cause the electrical characteristics of the connections to change during use. Such factors may cause an increase in the resistance of the connection and overheating.

In addition, physical manipulation of the wire during installation or vibration of a wiring device may cause the wire to become loose. Either can result in an increase in the resistance of the connection and overheating.

As noted, any of the above factors may result in detrimental changes in the connection which will cause overheating and load to fire. Generally, when overheating occurs during use, the overheating becomes progressive in nature and thus, terminal connections to aluminum wire present a special hazard.

THE SUBJECT TERMINAL

A wiring terminal constructed in accordance with the present invention is designed to overcome these problems and prevent overheating. It provides a stable terminal connection to aluminum wire of various grades having low electrical resistance and electrical characteristics that do not change under heavy load currents during use.

In this connection, the subject terminal complies with rigid performance requirements for connections to aluminum wire that are presently being prescribed by various advisory authorities such as Underwriters Laboratories. To meet such requirements and obtain approval, a terminal for connecting a wiring device to a source of current through an aluminum wire is subject to a test of 500 cycles at high current flow. This is an accelerated test and devices to be used in 15 amp. branch circuits are tested at a current flow of 40 amps. Devices to be used in 20 amp. branch circuits are tested at a current flow of 53 amps. In the tests, each cycle consists of 3½ hours with full current flowing and ½ hour with no current flowing. The terminal screw is tightened under a light torque of 6 inch lbs. to apply pressure urging the wire into engagement with the terminal plate. At the end of the twenty-fifth cycle of the test, the wire is disturbed to determine whether such movement will affect the electrical connection and this is repeated at the one hundred and twenty-fifth cycle.

In the vibration test, the device is vibrated in each of three directions or axes with the frequency of the vibrations being swept from 10 to 55 cycles per minute for one hour in each direction.

During the test, temperature measurements are taken at each terminal of the device and failure is indicated if the temperature of the terminal rises to 150° F. above the ambient temperature or there is a difference of more than 10° C. (19° F.) of any temperature reading from the average temperature rise above ambient of all the temperature readings taken on the terminal during the test. During the test, the temperature readings are taken at each twenty-five cycles and at each terminal of the wiring device.

Generally speaking, receptacles equipped with the subject terminals have met these tests. In this connection, it is noted that conventional terminals when connected to "good" aluminum wire generally fail between 120 to 250 cycles of the test with no wire disturbance and when connected to "bad" aluminum wire generally fail before 25 cycles of the test with no wire disturbance. This demonstrates the difference in the nature of the electrical connections to an aluminum wire established by a conventional terminal and by the subject terminal.

THE DRAWINGS

As an aid to understanding the invention the accompanying drawings schematically illustrate the manner in which a terminal embodying the invention establishes an electrical connection to aluminum wire. It will also be understood that different forms of terminals may embody the invention and the terminals may be used on various types of wiring devices. In the accompanying drawing.

Figure 1:
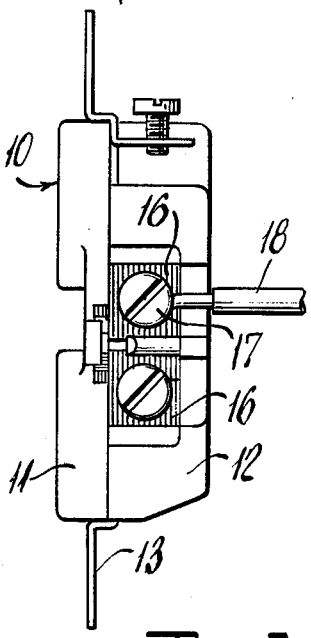
FIG. 1 is a side elevation view of a repectacle having a terminal which embodies the invention with an aluminum wire connected thereto.
Figure 2:
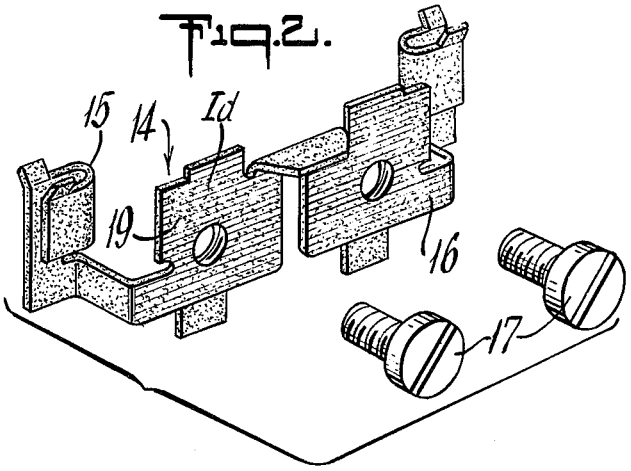
FIG. 2 is a perspective view illustrating a contact including the terminal forming part of the receptacle shown in FIG. 1.
Figure 3:
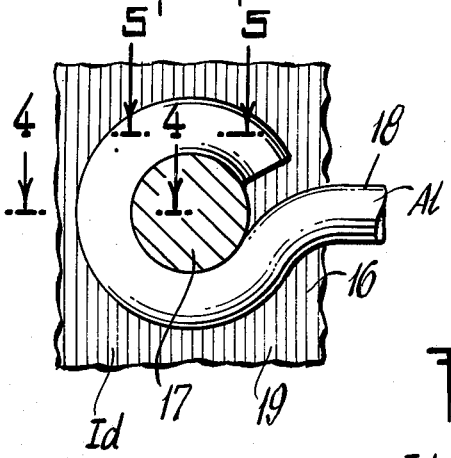
FIG. 3 is a fragmentary plan view of the terminal shown in FIG. 1 in transverse section through the terminal screw and which is drawn to an enlarged scale.
Figure 4:
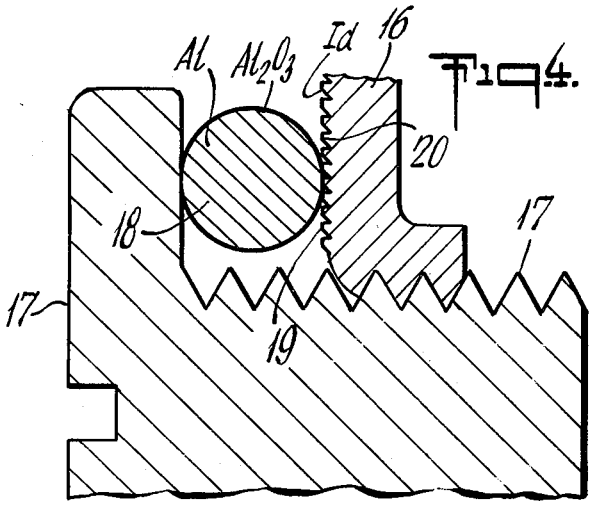
FIG. 4 is a fragmentary side view in vertical section taken along line 4—4 of FIG. 3 and is also drawn to an enlarged scale.

Referring to the drawing in detail, there is a double wall receptacle 10 for a connection in a household or industrial wiring circuit and which is installed in a customary flush box (not shown). It will be understood that terminals embodying the present invention may be employed, if desired, in other types of wiring devices.

The receptacle 10 is of a conventional construction and has a hollow housing formed by a cover 11 and a base 12 with the usual mounting strap 13 extending therethrough. The face of the cover 11 contains the usual openings which receive the prongs of a plug (not shown) to engage with spaced contact elements 14 supported within the housing. The contact elements 14 have spring contact fingers 15 at their ends positioned to engage with the prongs of the plug. A central portion of the contact element 14 extends along one side of the base 12 and is exposed to form a terminal plate 16. The terminal plate 16 is of the screw type and has a pair of spaced terminal screws 17 threaded therein. A similar contact element 14 is located on the opposite side of the housing.

In practice, the bare end of an electrical conductor or wire 18 is looped around the terminal screw 17 as shown in FIG. 1 and the head of the terminal screw 17 is tightened to hold the bare end of the wire 18 in engagement with the terminal plate 16 under pressure. The wire ordinarily used may range in size from No. 8 to No. 18 (AWG), but this is not intended as a limitation. The terminal construction described is conventional and forms no part of the present invention. However, with copper wire, reliance may be placed on engagement of the wire with the terminal plate. However, this is not sufficient in the case of aluminum wire because a thin film of aluminum oxide **18*a*** forms on the surface of the aluminum wire and acts as an insulator.

In order to overcome this problem and establish a path of low electrical resistance in a terminal for aluminum wire, the surface of the terminal plate 16 which opposes and engages with the aluminum wire 18 is provided with closely spaced minute serrations 19. The serrations 19 have sharp upper corners of edges which create random breaks or asperities in the oxide film **18*a* when the wire is brought into engagement with the serrations under pressure from the terminal screw 17. As diagrammatically illustrated in FIG. 5, the asperities establish a plurality of contact sites 18*b* where the aluminum wire is in good electrical contact with the terminal plate 16 at which electric current can flow between the wire 18 and the terminal plate 16** with low resistance.

To obtain the desired effect, it is desirable that the surface of the terminal plate 16 have fifty or more of the serrations 19 per inch and 70 to 100 of the serrations 19 per inch have been found to be highly effective. As illustrated, the serrations 19 run lengthwise of the terminal plate 16 so that a number of the serrations will extend transversely with respect to segments of a loop in the wire 18 formed around the terminal screw 17. However, as will be described, the serrations may be arranged in different patterns.

Figure 5:
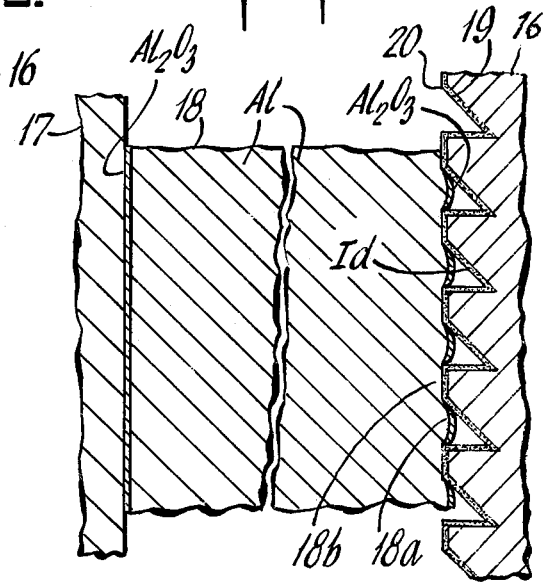
FIG. 5 is a fragmentary view in vertical section taken along line 5—5 of FIG. 3 and is drawn to a greatly enlarged scale to diagrammatically illustrate the engagement of a segment of the aluminum wire with the terminal plate under pressure from the terminal screw.
Figure 7:
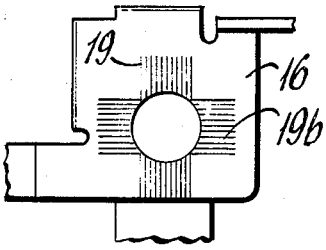
FIG. 7 is a fragmentary plan view of a modified form of terminal plate embodying the invention.

As illustrated in FIG. 5, the serrations 19 are truncated with vertical and inclined sides which form sharp edges or corners at their upper edges at the surface of the terminal plate 16 to engage with the wire. The sharp corners of the serrations 19 cause breaks or asperities in the oxide film on the aluminum wire under the pressure exerted on the wire by the terminal screw 17 and the greatest number of such breaks possible is desirable. However, the serrations 19 in the surface of the terminal plate 16 may be shallow and a depth of 0.005 to 0.001 inches will suffice. The serrations may be formed on the surface of the terminal plate 16 by striking the plate with a die having closely spaced sharp edges on its face.

In addition, the serrated surface of the terminal plate 16 is coated with a thin layer of indium (Id) which is designated generally by the reference numeral 20. For convenience, the layer 20 of indium may be applied to the entire contact element 14 by plating or dipping. A very thin layer 20 of indium is all that is required. For example, the layer of indium may have a thickness of from 0.00015 to 0.00025 inches and an average thickness of about 0.00020 inches is satisfactory.

The properties of indium (Id) are as follows: Indium is a conductive metal which is listed as an element in Group III A of the periodic tables. It has an atomic weight of 114.8 with a valence of 3 and is available in commercial quantities with a purity of 99.6%. Other features of indium are that it has a soft metal having a silvery white appearance with a melting point of 156.6° C. and a vaporization point of 2075° C. It has extremely good wetting properties which cause it to spread over a contacting surface of the wire. An important feature is that it will not work harden due to stresses caused by differences in the thermal expansion and contraction of the wire and the terminal or by cold flow of the aluminum wire. In addition, indium is difficult to oxidize and its oxide when formed acts as a semiconductor.

Indium alloys or mixture such as indium-lead, indium-tin, indium-cadmium, and indium-zinc will exhibit similar properties and may also be employed. In addition, gallium (Ga) has properties similar to indium and may also be used for the coating 20.

In this connection, it is noted that electrical contacts have been plated in the past with various metals to improve conductivity and prevent oxidation. However, such plating without the serrations has been of little effect in establishing satisfactory electrical connections to aluminum wire.

In theory, the indium coating 20 on the terminal plate 16 spreads over the asperities created in the oxide film on the wire by the serrations 19 on the terminal plate 16 and prevents the oxide film from reforming on the surface of the asperities. As noted above, the layer 20 of indium does not work harden and thus, retains its ability to protect the asperities in the oxide film on the wire during use. As a result, good electrical contact is maintained between the terminal plate 16 and the wire 18 which permits electric current to flow with low resistance between the wire 18 and the terminal plate 16.

In addition to the foregoing, the serrations 19 also serve to anchor the wire 18 against movement relative to the terminal plate 16 and thus, resist disturbance of the connection by movement of the wire or plate during installation of the wiring device in a flush box or due to the insertion of the contact prongs into the receptacle.

Figure 6:
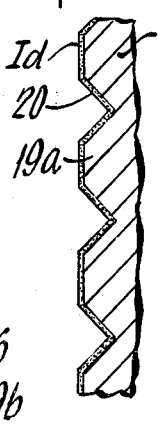
FIG. 6 is a fragmentary view in vertical section illustrating a modified form of terminal plate which embodies the invention and is also drawn to a greatly enlarged scale.

As shown in FIG. 6, the serrations 19*a* on the terminal plate 16 may have a truncated V-shaped configuration.

In addition, the serrations 19*b* on the terminal plate 16 may be arranged to extend vertically relative to the upper and lower sides of the threaded opening for the terminal screw as well as transversely relative thereto.

It will be understood that various modifications and changes may be made by those skilled in the art in the embodiments of the invention illustrated and described herein without departing from the scope or spirit of the invention.

We claim:

1. In a terminal for establishing a stable electrical connection between an electrical wiring device and a looped bare end of an aluminum wire ranging in size from No. 8 to No. 18 (AWG) and having an aluminum oxide film on said bare end in a branch wiring circuit which is capable of carrying substantial load currents without overheating, the combination comprising:

a. a terminal plate of electrically conductive material having an exposed wire-engaging surface and a screw threadably engaging with said plate in the midst of said surface for receiving said looped bare wire end;

b. said wire-engaging surface having on one side of said screw an area for receiving the terminating portion of said looped bare wire end and on the opposite side of said screw an area for receiving another portions of said looped bare wire end in a direction substantially parallel to said terminating portion;

c. at least said areas of said wire-engaging surface containing 50 to 100 serrations per inch positioned at a substantial angle to said direction for engagement with said looped bare end of said aluminum wire under pressure exerted on the wire;

d. said serrations having truncated upper ends terminating in sharp side edges and having depths of 0.001 to 0.005 of an inch;

e. said sharp side edges being effective when engaging with the wire under pressure exerted thereon for creating a multitude of breaks in the oxide film on the bare end of the wire and establishing contact sites permitting current flow at low resistance between the terminal plate and the wire to prevent the aforesaid overheating; and f. a protective layer of metal deposited on said wire-engaging surface;

g. the metal of said layer comprising a flowable, soft metal and being selected from a group of metals comprising indium, indium alloys, gallium and gallium alloys;

h. said protective layer having a thickness of 0.00015 to 0.00025 of an inch, i. said screw having a headed end for engaging with and urging the said bare end of said wire into engagement with said serrations on the wire-engaging surface of said plate with the engagement being secure even if the torque acting on the screw is no more than six-inch pounds.

2. A terminal as in claim 1 including in the said combination, the said aluminum wire with said looped bare end being at least partially under said screw head and secured thereby to said terminal plate with a screw torque of six-inch pounds.

3. A terminal as in claim 1 including an electrical wiring device for installation in said branch circuit, said device having the said terminal plate mounted therein.

4. In a terminal for establishing a stable electrical connection between a bare end of an aluminum wire and an electrical wiring device, the combination as defined in claim 1 wherein:

a. the serrations extend transversely of said direction.

5. A terminal as in claim 4 including a further set of serrations on said wire-engaging surface and extending in a direction generally parallel to said direction on at least the side of said screw which receives the loop part of said bare wire between its said terminating and another portions.

* * * * *